US009774947B2

(12) United States Patent
Kim

(10) Patent No.: US 9,774,947 B2
(45) Date of Patent: Sep. 26, 2017

(54) SUBWOOFER STRUCTURE FOR VEHICLE

(71) Applicant: Hyundai Motor Company, Seoul (KR)

(72) Inventor: Young Kim, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/192,717

(22) Filed: Jun. 24, 2016

(65) Prior Publication Data

US 2017/0171659 A1 Jun. 15, 2017

(30) Foreign Application Priority Data

Dec. 14, 2015 (KR) ..... 10-2015-0178647

(51) Int. Cl.
*H04R 1/02* (2006.01)
*H04R 1/28* (2006.01)
*H04R 7/16* (2006.01)

(52) U.S. Cl.
CPC ..... *H04R 1/2842* (2013.01); *H04R 1/026* (2013.01); *H04R 1/2849* (2013.01); *H04R 7/16* (2013.01); *H04R 2499/13* (2013.01)

(58) Field of Classification Search
CPC ..... H04R 1/02; H04R 1/025; H04R 1/026; H04R 1/2803; H04R 1/2819; H04R 1/2823; H04R 1/2892; H04R 2499/13; H04R 2201/021; B60R 11/0217; B60R 11/0029
See application file for complete search history.

(56) References Cited

U.S. PATENT DOCUMENTS

| | | | | | |
|---|---|---|---|---|---|
| 4,696,369 | A * | 9/1987 | Dodrill | B60R 11/0217 | 381/86 |
| 5,287,412 | A * | 2/1994 | Etzel | H04R 1/2842 | 381/86 |
| 6,031,924 | A * | 2/2000 | Etzel | H04R 1/025 | 381/386 |
| 2012/0091866 | A1* | 4/2012 | Walker | H04R 1/026 | 312/7.1 |

FOREIGN PATENT DOCUMENTS

| | | | |
|---|---|---|---|
| DE | 102008015490 | A1 | 10/2009 |
| EP | 0904985 | A1 | 3/1999 |
| JP | H08253082 | A | 10/1996 |
| JP | H10291443 | A | 11/1998 |
| JP | 2010-245655 | A | 10/2010 |
| KR | 10-1997-0058255 | A | 7/1997 |
| KR | 20-1998-046499 | U | 9/1998 |
| KR | 10-2003-0078120 | A | 10/2003 |

* cited by examiner

*Primary Examiner* — Thang Tran
(74) *Attorney, Agent, or Firm* — Mintz Levin Cohn Ferris Glovsky and Popeo, P.C.; Peter F. Corless

(57) ABSTRACT

A subwoofer structure for a vehicle includes: an enclosure mounted to a speaker; a floor panel to which the enclosure is mounted, a first soundbox space being formed in the floor panel; a seat cross reinforcing member having a second soundbox space that communicates with the first soundbox space; and a side sill having a third soundbox space that communicates with the second soundbox space.

6 Claims, 9 Drawing Sheets

SUBWOOFER STRUCTURE FOR VEHICLE

CROSS-REFERENCE TO RELATED APPLICATION

This application claims under 35 U.S.C. §119(a) the benefit of Korean Patent Application No. 10-2015-0178647 filed in the Korean Intellectual Property Office on Dec. 14, 2015, the entire contents of which are incorporated herein by reference.

BACKGROUND (a) Field of the Invention

The present invention relates to a subwoofer structure for a vehicle, and more particularly, to a subwoofer structure in which a speaker enclosure is connected to a floor panel of a vehicle body, the floor panel is connected to a seat cross member, and the seat cross member is connected to a side sill member, in order to output low-pitched sounds through the speaker enclosure and the vehicle body.

(b) Description of the Related Art

In general, a subwoofer serves to reproduce low-pitched sounds or ultra-low-pitched sounds. In a vehicle, a subwoofer and an additional enclosure typically are mounted in a trunk of the vehicle to reproduce low-pitched sounds.

Further, a vehicle body may be employed to increase a capacity of the enclosure. For example, the subwoofer may be mounted to a floor panel of the vehicle body, and a side sill constituting a side lower portion of the vehicle body may be connected and communicated with the subwoofer, such that the side sill serves as a speaker enclosure.

As described above, when such a conventional subwoofer is mounted to a vehicle, it is necessary to improve a quality of the subwoofer by effectively increasing an enclosure capacity through the vehicle body.

The above information disclosed in this Background section is only for enhancement of understanding of the background of the invention and therefore it may contain information that does not form the prior art that is already known in this country to a person of ordinary skill in the art.

SUMMARY

The present invention provides a subwoofer structure for a vehicle, having advantages of being capable of providing high-quality low-pitched sounds to a passenger in the vehicle by mounting a subwoofer to a lower portion of a seat, and improving low-pitched output of the subwoofer by effectively increasing an enclosure space through the connection of the subwoofer with a vehicle body.

An exemplary embodiment of the present invention provides a subwoofer structure for a vehicle, including: an enclosure mounted to a speaker; a floor panel to which the enclosure is mounted, a first soundbox space being formed in the floor panel; a seat cross reinforcing member configured to include a second soundbox space that communicates with the first soundbox space; and a side sill configured to include a third soundbox space that communicates with the second soundbox space.

A hole having a predetermined size may be formed in the floor panel, and the enclosure may be mounted to the floor panel to cover the hole.

A pad may be attached to a bottom surface of the enclosure, an insertion groove may be formed along an edge of the pad, and an edge of the hole may be inserted and fitted into the insertion groove.

A plurality of first communication holes may be formed in the floor panel, a plurality of second communication holes may be formed in the seat cross reinforcing member to communicate with the first communication holes; and a third communication hole may be formed in a side surface of the side sill to communicate with the seat cross reinforcing member.

A bracket may be separately attached to a top surface of the seat cross reinforcing member at a predetermined distance, to form a port between the bracket and the seat cross reinforcing member.

A width-directional central portion of the bracket may be attached to the top surface of the seat cross reinforcing member to form the port as two channels.

The two channels may be formed to extend in a longitudinal direction of the bracket.

The two channels may be adjacently disposed in parallel.

In accordance with the subwoofer structure for the vehicle according to the exemplary embodiment of the present invention vehicle, strong low-pitched sounds can be conveniently heard at all seats inside the vehicle by mounting a subwoofer below the seats.

Low-pitched sounds or ultra-low-pitched sounds can be vividly heard and felt by using an internal space of a vehicle body as an enclosure space.

A port-type enclosure system can be realized by forming a port by use of the seat cross reinforcing members and the bracket bonded thereto. Accordingly, it is possible to effectively reproduce ultra-low-pitch sounds.

DETAILED DESCRIPTION OF THE EMBODIMENTS

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogenpowered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, an exemplary embodiment of the present invention will be described in detail with reference to accompanying drawings.

Figure 1:
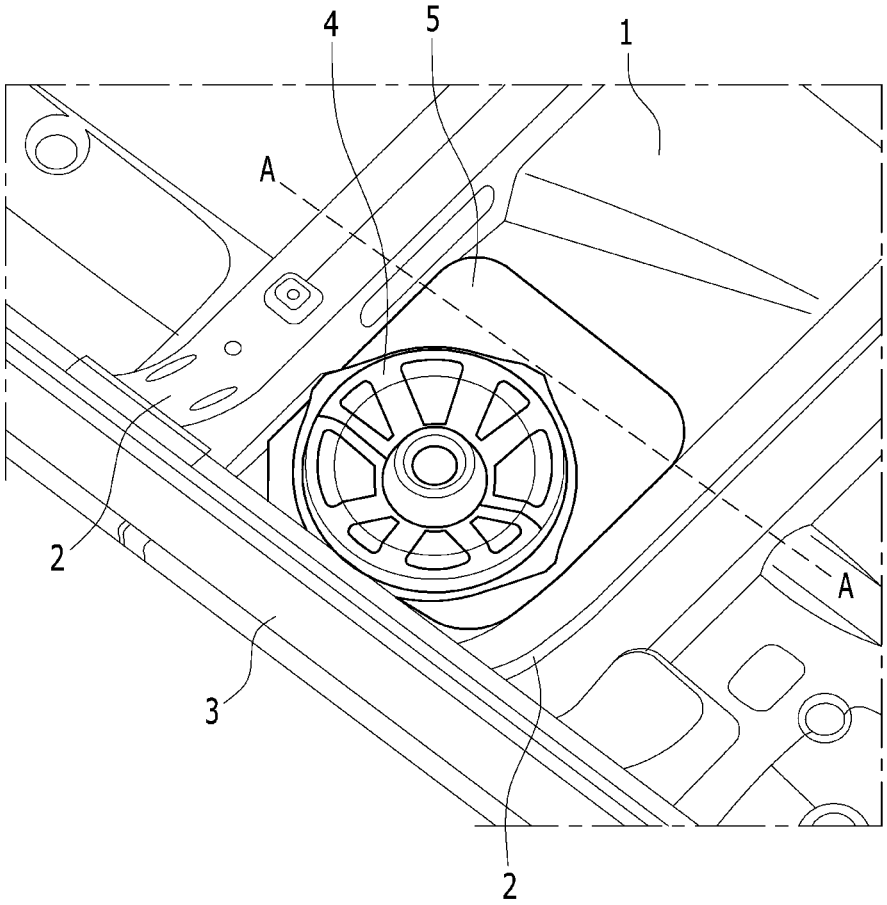
FIG. 1 is a top plan view illustrating a subwoofer structure for a vehicle according to an exemplary embodiment of the present invention.

Referring to FIG. 1, in a floor panel 1 of a vehicle, seat cross reinforcing members 2 are disposed to extend in a width direction of the vehicle, and are coupled to the vehicle.

A side sill 3 is disposed to extend in a longitudinal direction of the vehicle at opposite ends of the floor panel 1, and is coupled to the vehicle.

A speaker 4 and an enclosure 5 thereof are interposed between the seat cross reinforcing members 2, and the speaker 4 and the enclosure 5 are mounted in the floor panel 1.

An empty space may be formed inside the side sill 3 and the seat cross reinforcing members 2.

The floor panel 1, the seat cross reinforcing members 2, and the side sill 3 may be communicated with and coupled to each other, and thus empty spaces formed in floor panel 1, the seat cross reinforcing members 2, and the side sill 3 may serve as soundboxes for reproducing low-pitched sounds or ultra-low-pitched sounds.

Figure 2:
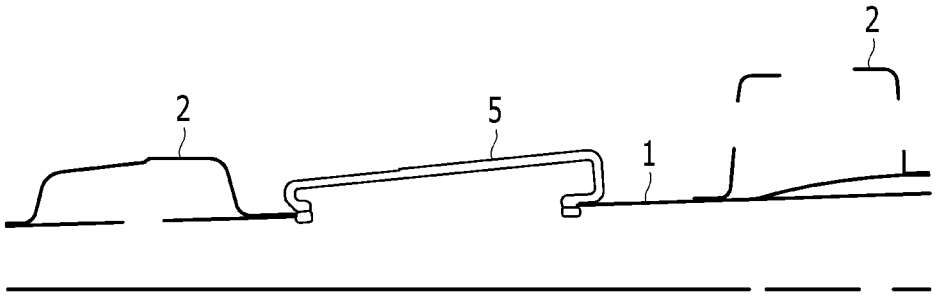
FIG. 2 is a cross-sectional view taken along the line A-A of FIG. 1.
Figure 3:
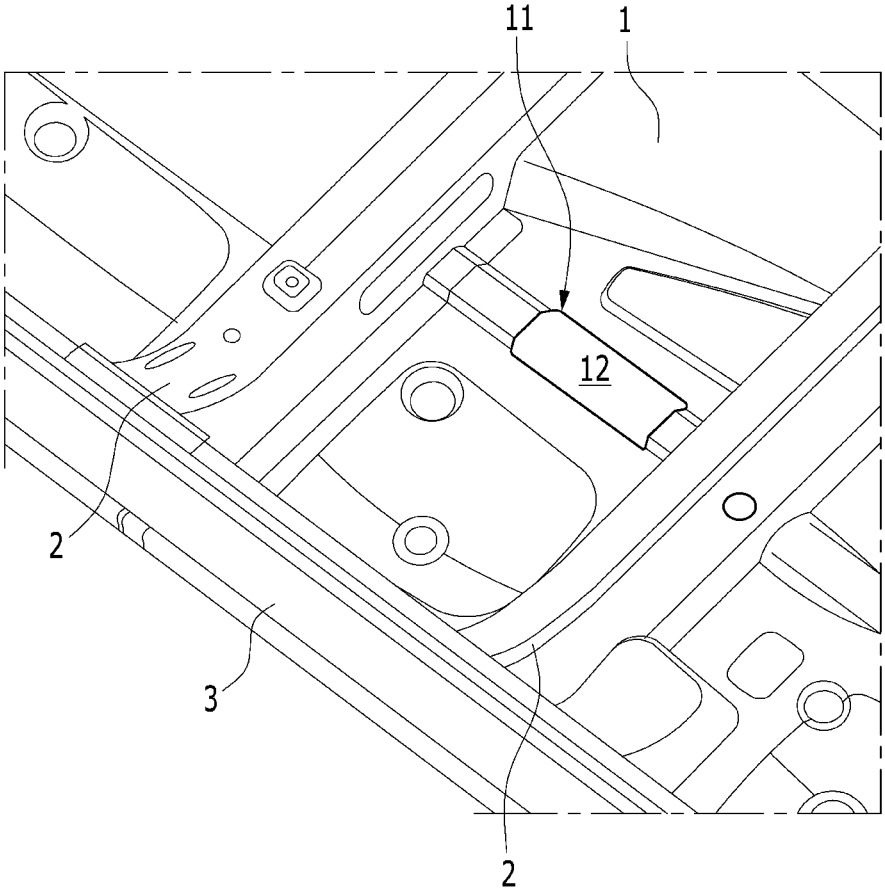
FIG. 3 is a partial top plan view illustrating a peripheral vehicle body according to an exemplary embodiment of the present invention.

Referring to FIGS. 2 and 3, when the enclosure 5 is mounted to the floor panel 1, a hole 11 having an appropriate size may be formed so as to be covered by the enclosure 5.

In the floor panel 1, a first soundbox space 12 may be formed to communicate with the hole 11.

Figure 4:
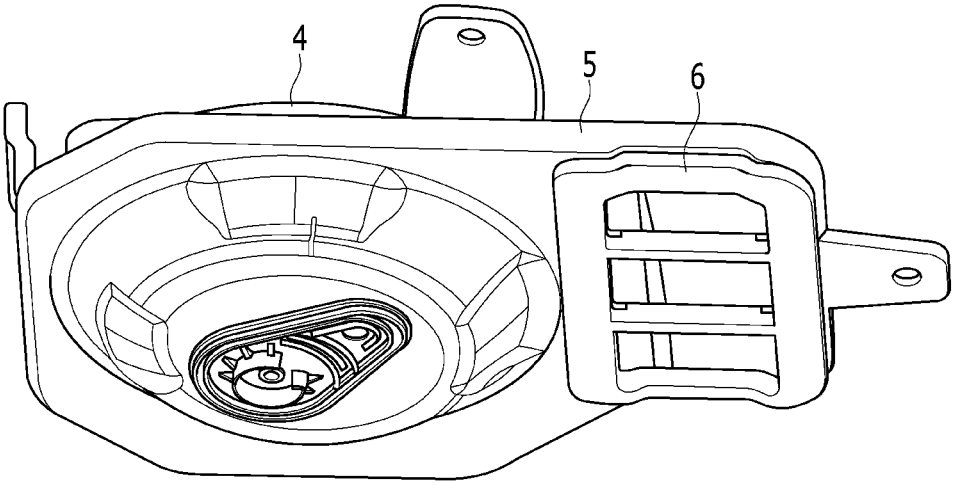
FIG. 4 is a perspective view illustrating a vehicle subwoofer according to an exemplary embodiment of the present invention.
Figure 5:
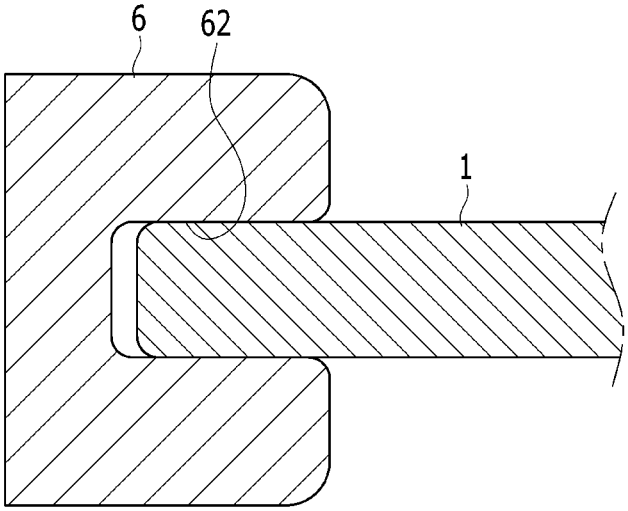
FIG. 5 is a cross-sectional view illustrating coupling of a subwoofer pad and a floor panel according to an exemplary embodiment of the present invention.

Referring to FIGS. 4 and 5, a pad 6 may be attached to a bottom surface of the enclosure 4. An insertion groove 62 may be formed by internally being cut along an edge of the pad 6.

When the enclosure 5 is mounted to the floor panel 1 in such a shape so as to cover the hole 11 of the floor panel 1, the edge 12 of the hole 11 is fitted into and mounted to the insertion groove 62 of the pad 6, thereby improving watertightness and improving sound transmission through the enclosure 5.

Figure 6:
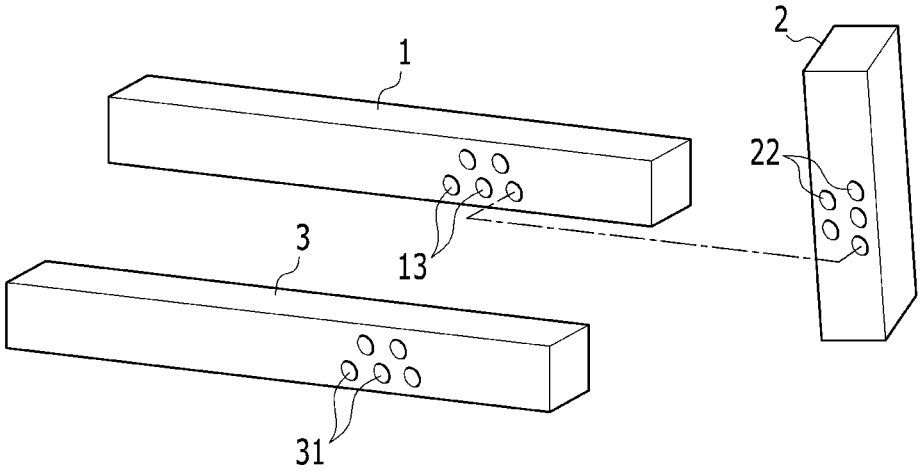
FIG. 6 is a partially cut-off perspective view illustrating vehicle body members having communication holes according to an exemplary embodiment of the present invention.

Referring to FIG. 6, to allow the floor panel 1 to communicate with the seat cross reinforcing members 2, a plurality of communication holes 13 are formed on a side surface of the floor panel 1 which faces the seat cross reinforcing members 2, and a plurality of communication holes 22 are formed on a side surface of each of the seat cross reinforcing members 2.

The communication holes 13 and 22 facilitate transmission of sounds transmitted through the enclosure 5 to the seat cross reinforcing members 2.

The communication holes 13 and 22 preferably are formed to have a small size in order to maintain rigidity of the floor panel 1 and the seat cross reinforcing members 2.

Further, a plurality of communication holes 31 may be formed on a surface of the side sill 3 to communicate with the seat cross reinforcing members 2

Figure 7:
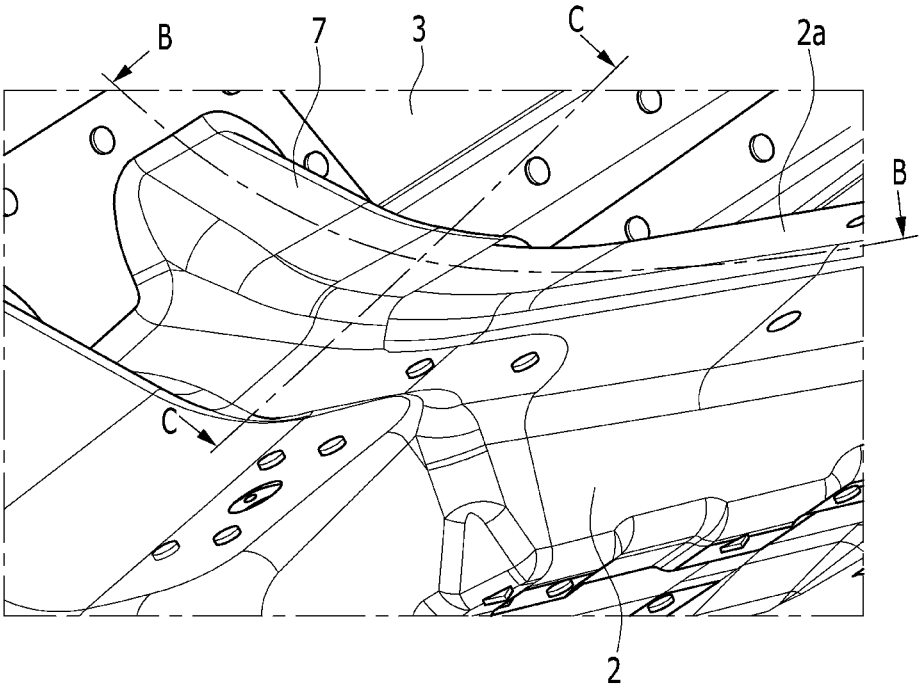
FIG. 7 is a perspective view illustrating coupling of a seat cross reinforcing member and a side sill according to an exemplary embodiment of the present invention.
Figure 8:
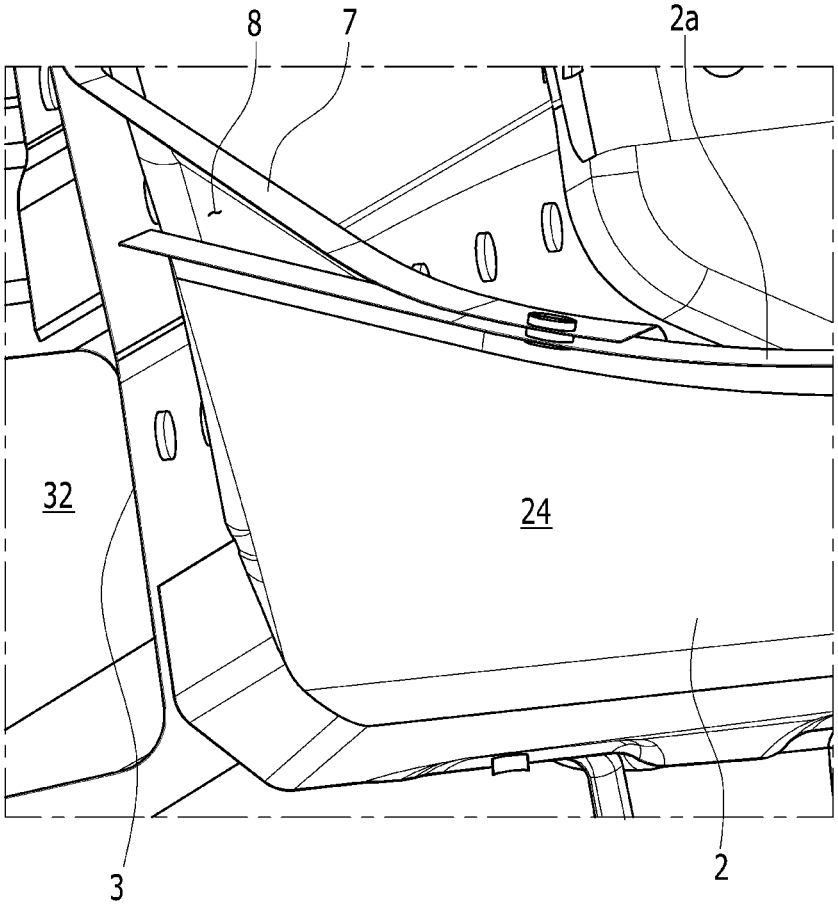
FIG. 8 is a cross-sectional view taken along the line B-B of FIG. 7.
Figure 9:
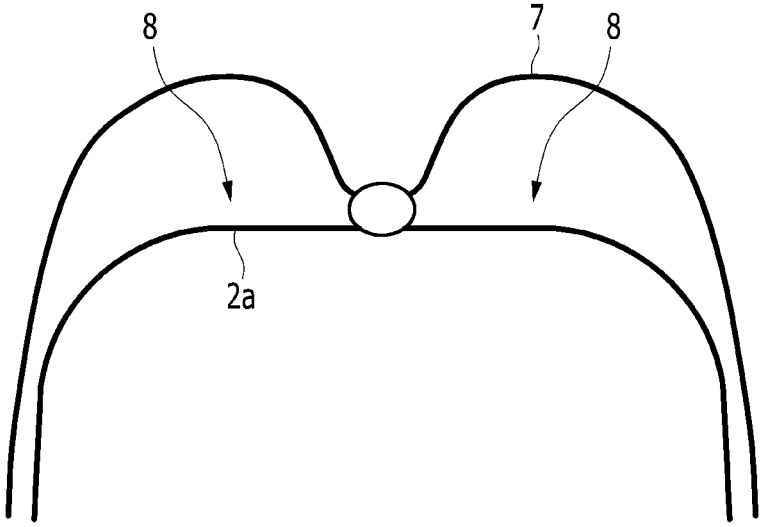
FIG. 9 is a cross-sectional view taken along the line C-C of FIG. 7.

Referring to FIGS. 7 to 9, a port-type enclosure system may be applied to enable the subwoofer to output ultra-low-sounds.

Specifically, a bracket 7 is mounted to a top surface 2*a* of the seat cross reinforcing member 2 in a height direction of the vehicle, in such a shape so as to separately cover the top surface 2*a* at a predetermined distance, and a gap is formed between the bracket 7 and the top surface 2*a* to serve as a port 8.

A length of the port 8 can be easily controlled by adjusting a length of the bracket 7.

The port 8 may be formed to reduce booming noises of low-pitched sounds.

As illustrated in detail in FIG. 9, in the case of the port 8, a central portion of the bracket 7 is welded to the top surface 2*a* to form two channels in parallel.

In the subwoofer structure for the vehicle according to the exemplary embodiment of the present invention vehicle, the enclosure 5 can be formed to have a sufficient soundbox capacity through the first soundbox space 12 formed in the floor panel 1, a second soundbox space 24 (see FIG. 8) formed in the seat cross reinforcing members 2, and a third soundbox space 32 (see FIG. 8) formed in the side sill 3, thereby efficiently generating low-pitched sounds or ultra-low-pitched sounds.

As described above, in accordance with the subwoofer structure for the vehicle according to the exemplary embodiment of the present invention vehicle, strong low-pitched sounds can be conveniently heard at all seats inside the vehicle by mounting a subwoofer below the seats, low-pitched sounds or ultra-low-pitched sounds can be vividly heard and felt by using an internal space of a vehicle body as an enclosure space, and a port-type enclosure system can be realized by forming a port by use of the seat cross reinforcing members 2 and the bracket 7. Accordingly, it is possible to effectively reproduce ultra-low-pitch sounds.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A subwoofer structure for a vehicle, the subwoofer structure comprising:

an enclosure mounted to a speaker;

a floor panel to which the enclosure is mounted, a first soundbox space being formed in the floor panel;

a seat cross reinforcing member configured to include a second soundbox space that communicates with the first soundbox space; and a side sill configured to include a third soundbox space that communicates with the second soundbox space, wherein a bracket is separately attached to a top surface of the seat cross reinforcing member at a predetermined distance, to form a port between the bracket and the seat cross reinforcing member, and a width-directional central portion of the bracket is attached to the top surface of the seat cross reinforcing member, to form the port as two channels.

2. The subwoofer structure of claim 1, wherein a hole having a predetermined size is formed in the floor panel, and the enclosure is mounted to the floor panel to cover the hole.

3. The subwoofer structure of claim 2, wherein:

a pad is attached to a bottom surface of the enclosure, an insertion groove is formed along an edge of the pad, and an edge of the hole is inserted and fitted into the insertion groove.

4. The subwoofer structure of claim 1, wherein:

a plurality of first communication holes are formed in the floor panel, a plurality of second communication holes are formed in the seat cross reinforcing member to communicate with the first communication holes, and a third communication hole is formed in a side surface of the side sill to communicate with the seat cross reinforcing member.

5. The subwoofer structure of claim 1, wherein the two channels are formed to extend in a longitudinal direction of the bracket.

6. The subwoofer structure of claim 1, wherein the two channels are adjacently disposed in parallel.

* * * * *